US010696445B2

(12) United States Patent
Miller

(10) Patent No.: US 10,696,445 B2
(45) Date of Patent: Jun. 30, 2020

(54) CARTON WITH INTEGRAL DISPLAY TAG

(71) Applicant: U.S. Cotton, LLC, Gastonia, NC (US)

(72) Inventor: Abby Morgan Miller, Amherst, OH (US)

(73) Assignee: U.S. COTTON, LLC, Gastonia, NC (US)

( * ) Notice: Subject to any disclaimer, the term of this patent is extended or adjusted under 35 U.S.C. 154(b) by 46 days.

(21) Appl. No.: 15/977,499

(22) Filed: May 11, 2018

(65) Prior Publication Data

US 2019/0061992 A1 Feb. 28, 2019

Related U.S. Application Data

(60) Provisional application No. 62/549,625, filed on Aug. 24, 2017.

(51) Int. Cl.

| | |
|---|---|
| ***B65D 5/42*** | (2006.01) |
| ***B65D 5/54*** | (2006.01) |
| *B65D 5/52* | (2006.01) |
| *B65D 5/02* | (2006.01) |

(52) U.S. Cl.

CPC ..... *B65D 5/4229* (2013.01); *B65D 5/542* (2013.01); *B65D 5/5445* (2013.01); *B65D 5/0227* (2013.01); *B65D 5/5226* (2013.01); *B65D 2203/02* (2013.01)

(58) Field of Classification Search

CPC .... B65D 5/4229; B65D 5/542; B65D 5/5445; B65D 5/0227; B65D 5/5226; B65D 2203/02; B65D 5/4216; B65D 5/4233

USPC ..... 206/767, 459.5; 40/312

See application file for complete search history.

(56) References Cited

U.S. PATENT DOCUMENTS

| | | | | | |
|---|---|---|---|---|---|
| 1,033,550 | A | | 7/1912 | Crankshaw | |
| 2,812,852 | A | | 11/1957 | Samuels | |
| 2,914,236 | A | * | 11/1959 | Shapiro | B65D 5/4225 206/767 |
| 3,167,179 | A | | 1/1965 | Goldstein | |
| 3,674,133 | A | * | 7/1972 | Locke | B65D 5/2038 206/767 |
| 3,765,044 | A | * | 10/1973 | Hanahan | A47L 13/52 15/104.8 |
| 4,206,869 | A | * | 6/1980 | Gurevitz | B65D 5/22 229/117.18 |
| 4,694,955 | A | | 9/1987 | Rank, Jr. | |
| 4,756,409 | A | * | 7/1988 | Murray | B65D 5/4225 206/232 |
| 5,752,600 | A | | 5/1998 | Kurashina et al. | |

(Continued)

FOREIGN PATENT DOCUMENTS

| | | |
|---|---|---|
| DE | 29621214 | 2/1997 |
| GB | 2388362 | 11/2003 |

(Continued)

*Primary Examiner* — Steven A. Reynolds

(74) *Attorney, Agent, or Firm* — Trego, Hines & Ladenheim, PLLC

(57) ABSTRACT

A blank for a carton includes: a sheet of material defining a plurality of panels separated by a plurality of fold lines, the panels defining an enclosure including first perforation lines which demarcate a separation of the enclosure into a lower portion and an upper portion; the panels within the lower portion defining an open-top enclosure; and the upper portion including second perforation lines defining a display tag.

16 Claims, 3 Drawing Sheets

(56) References Cited

U.S. PATENT DOCUMENTS

| | | | | |
|---|---|---|---|---|
| 5,762,203 | A | 6/1998 | Klawiter et al. | |
| 6,837,379 | B2 | 1/2005 | Dennis et al. | |
| 8,955,677 | B2 * | 2/2015 | Ladler-Dennis | B65D 85/00 206/232 |
| 2003/0150773 | A1 * | 8/2003 | Dennis | B65D 5/4216 206/767 |
| 2014/0048444 | A1 * | 2/2014 | Scatterday | B65D 5/54 206/767 |
| 2015/0136843 | A1 * | 5/2015 | Bell | B65D 5/5021 229/120.13 |
| 2015/0329235 | A1 | 11/2015 | Armiento et al. | |

FOREIGN PATENT DOCUMENTS

| | | |
|---|---|---|
| JP | 2007161330 | 6/2007 |
| JP | 2012176765 | 9/2012 |
| WO | 2015169961 | 11/2015 |
| WO | 2017048442 | 3/2017 |

* cited by examiner

CARTON WITH INTEGRAL DISPLAY TAG

CROSS-REFERENCE TO RELATED APPLICATIONS

This application claims the benefit of provisional patent application 62/549,625 filed Aug. 24, 2017.

BACKGROUND OF THE INVENTION

This invention relates generally to packaging, and more particularly to a combination packaging and display container.

It is known to store and ship retail products in cartons made from fibrous materials such as paper, chipboard, or corrugated cardboard.

It also is known to manufacture cartons having removable portions which can be separated and discarded to expose a product inside, thus forming a display which may be placed on a store shelf.

One problem with such cartons is that the removable portions are typically discarded and thus completely wasted.

BRIEF SUMMARY OF THE INVENTION

This problem is addressed by a carton having an integral display tag which forms a portion of a removable section of the carton.

According to one aspect of the technology described herein, a blank for a carton includes: a sheet of material defining a plurality of panels separated by a plurality of fold lines, the panels defining an enclosure including first perforation lines which demarcate a separation of the enclosure into a lower portion and an upper portion; the panels within the lower portion defining an open-top enclosure; and the upper portion including second perforation lines defining a display tab.

According to another aspect of the technology described herein, a carton includes: a plurality of interconnected panels which define an outer enclosure, the panels including first perforation lines which demarcate a separation of the outer enclosure into a lower portion and an upper portion; the upper portion including second perforation lines defining a display tag; and the lower portion including third perforation lines defining a small piece that may be punched out to form a slot sized to receive a portion of the display tag therein.

According to another aspect of the technology described herein, a method of displaying a product includes: providing a carton including a plurality of interconnected panels which define an enclosure, the panels including first perforation lines which demarcate a separation of the outer enclosure into a lower portion and an upper portion, the upper portion further including second perforation lines defining a display tag, wherein at least one product is contained within the enclosure; separating the upper portion from the lower portion along the first perforation lines and removing the upper portion to expose the at least one product contained within the lower portion; separating display tag from the upper portion along the second perforation lines; and attaching the display tag to the lower portion.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
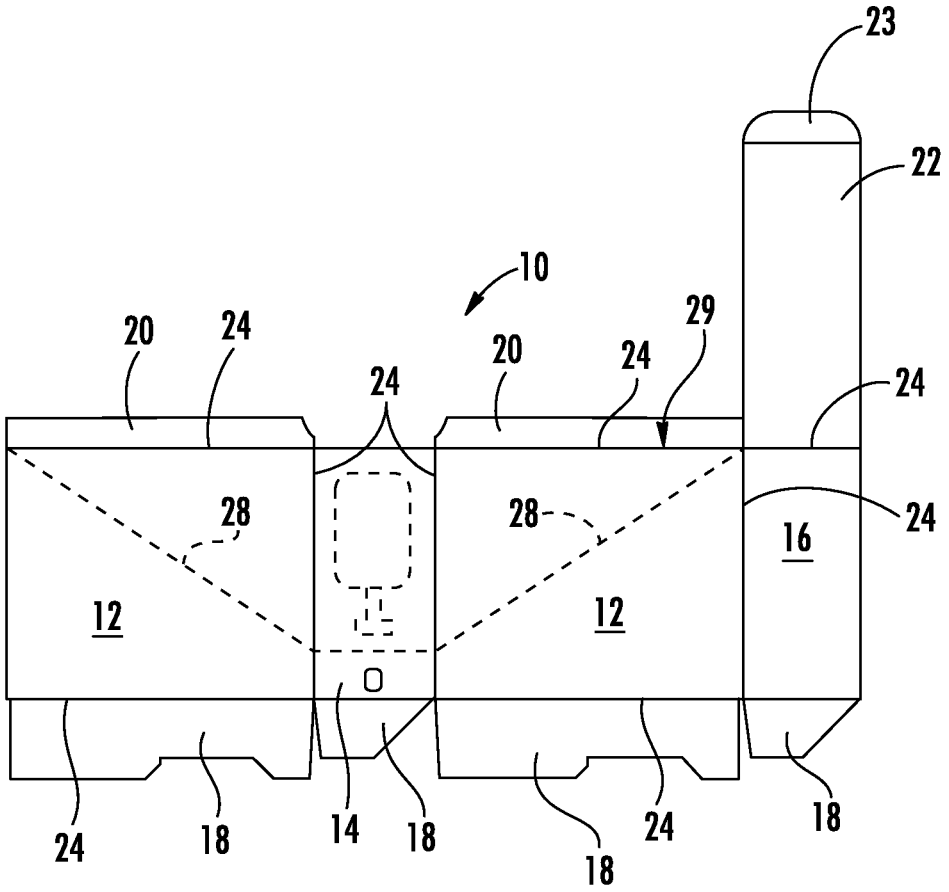
FIG. 1 is a top plan view of a flat carton blank for an exemplary carton having an integral display tag.

Referring to the drawings wherein identical reference numerals denote the same elements throughout the various views, FIG. 1 illustrates an exemplary carton blank 10, which may be cut (e.g., by die-cutting, laser cutting, water jet cutting, etc.) from sheet stock according to a predetermined pattern.

The blank 10 may be made from any sheet stock or sheet-like material that is capable of being formed in a predetermined shape (e.g. by cutting) and folded, including, for example, paper or other fibrous materials, cardboard, card stock, chip board, plastic, or sheet metal. One example of a common material for such cartons is a product made from cellulosic fiber commercially known as "U-board" or "chipper", which is a thin, single-layer material. Another common material is double-walled cardboard with a fluted spacer positioned between two outer layers, commonly referred to as "corrugated" cardboard.

In the illustrated example, the blank 10 defines side walls 12, a front wall 14, a back wall 16, bottom flaps 18, top tabs 20, and a top flap 22 with an end tab 23 at its distal end. These elements are demarcated by fold lines 24 which may be marked by printing. Alternatively, the fold lines 24 may represent physical areas of weakness prone to folding, defined for example by scoring, crimping, pre-folding, or partially cutting. Alternatively, they may simply be virtual lines along which folds take place during a manufacturing process.

Figure 2:
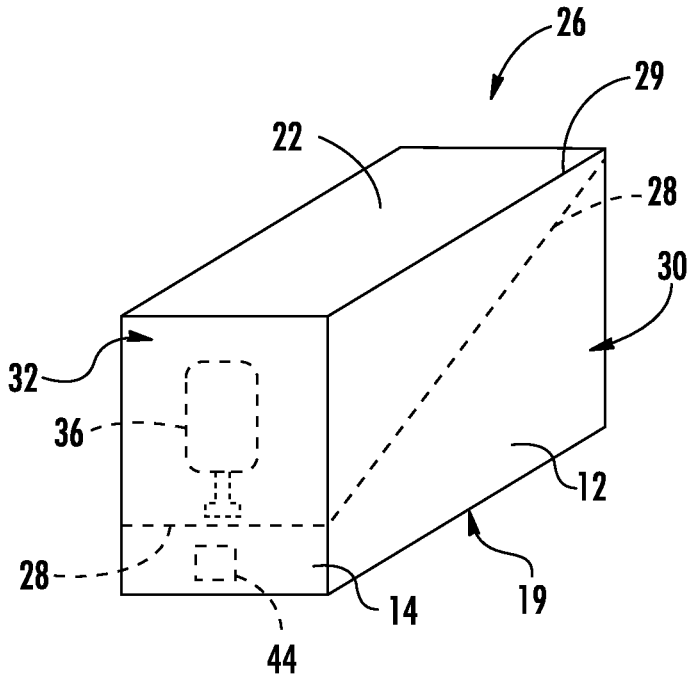
FIG. 2 is a perspective view of a carton assembled from the blank of FIG. 1.

The blank 10 may be assembled by folding it along the fold lines 24, and secured together by means such as friction, interlocking of tabs, adhesives, fasteners, or combinations thereof, to form a carton 26 (FIG. 2).

The carton 26 is generally a parallelepiped shape when assembled and is used to store products therein. When assembled, the sidewalls 12 are parallel and spaced apart from each other, and the front wall 14 and the back wall 16 are parallel and spaced apart from each other. The bottom flaps 18 are secured together to collectively define a bottom panel 19. In the illustrated example, the top flap 22 may be left open initially and then closed after the carton 26 is filled with products. The top flap 22 would be closed by folding down the top tabs 20, folding down the top flap 22, and inserting the end tab 23 between the top tabs 20 and the front wall 14. The end tab 23 may be retained by various means such as friction, interlocking, adhesives, fasteners or combination thereof. When the top flap 22 is closed, the carton 26 forms a complete six-sided enclosure with a hollow interior.

First perforation lines 28 extend diagonally across the side walls 12 and laterally across the front wall 14 and separate a lower portion 30 of the carton 26 from an upper portion 32. "Diagonally" refers to the first perforation lines 28 being at a non-parallel, non-perpendicular angle to a top edge 29 of the side walls 12. The first perforation lines 28 represent lines of relative weakness permitting easy tearing. They may be formed, for example, by deep scoring, partially cutting, or punching a series of small holes or slots. When the upper portion 32 is torn away along the first perforation lines 28 and removed, the lower portion 30 retains product 34 therein and exposes the product 34 on the shelf (not shown), functioning as a shelf display. A key feature of the lower portion 30 is it includes a bottom panel and defines a perimeter wall so as to retain the product therein. This structure is referred to generally herein as an "open-top enclosure". In the illustrated example, the lower portion 30 includes a relatively short front wall, a relatively tall back wall, and sloping sidewalls interconnecting the front and back walls. Other arrangements of the perforation lines 28 are possible to create different shapes of the upper and lower portions 32, 30. For example, the lower portion 30 could be a "U" shape.

The upper portion 32 includes second perforation lines 36 defining a display tag 38. The display tag 38 comprises a body 40, which provides a space for text matter or graphics, and a tab 42, which is T-shaped in the illustrated example. In the illustrated example, the body 40 is generally rectangular with two longer parallel edges and to shorter parallel edges interconnected by radiused corners and the tab 42 extends from one of the short edges of the rectangular body 40. However, it will be understood that any size or shape of display tag 38 that will fit on the upper portion 32 may be used. It will be further understood that the display tag could be defined entirely within one of the flat panels of the upper portion 32, or it could extend across one or more of the folded edges, thus being defined from two or more of the flat panels making up the upper portion 32 (including, if desired, the top flap 22).

The front wall 14 of the lower portion 30 includes third perforation line or lines 44 defining a small piece that may be punched out to form a slot 46. While the illustrated example shows a generally rectangular slot 46, a simple narrow slot or even a single perforation line defining a slit could be substituted.

Figure 3:
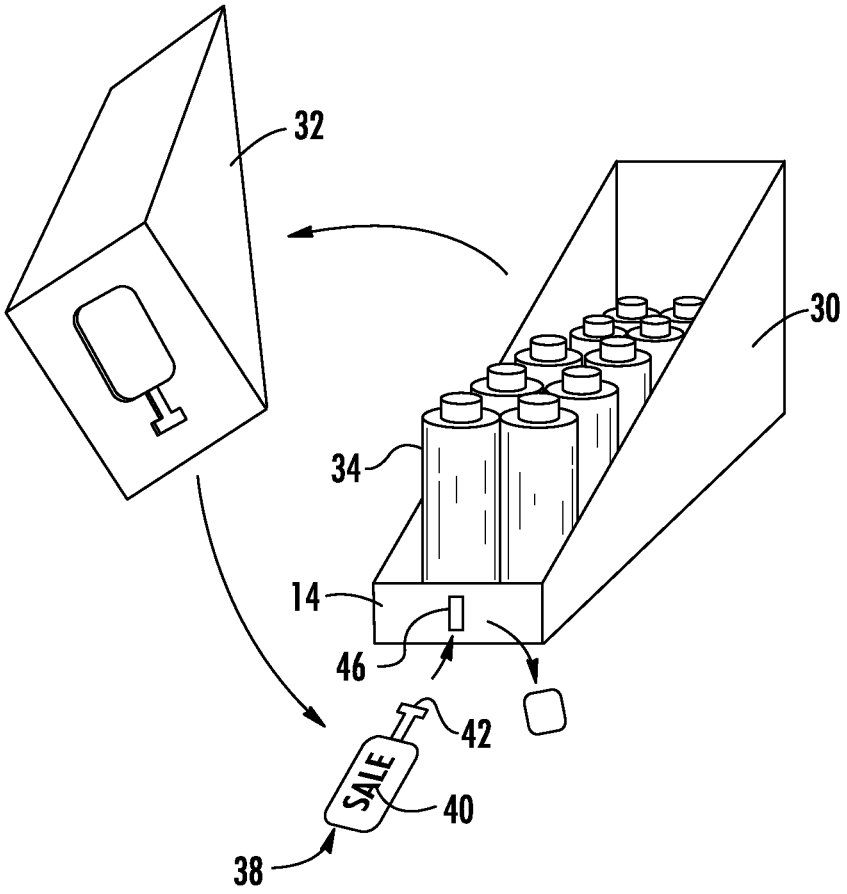
FIG. 3 is an exploded perspective view showing a process of opening the carton of FIG. 2.
Figure 4:
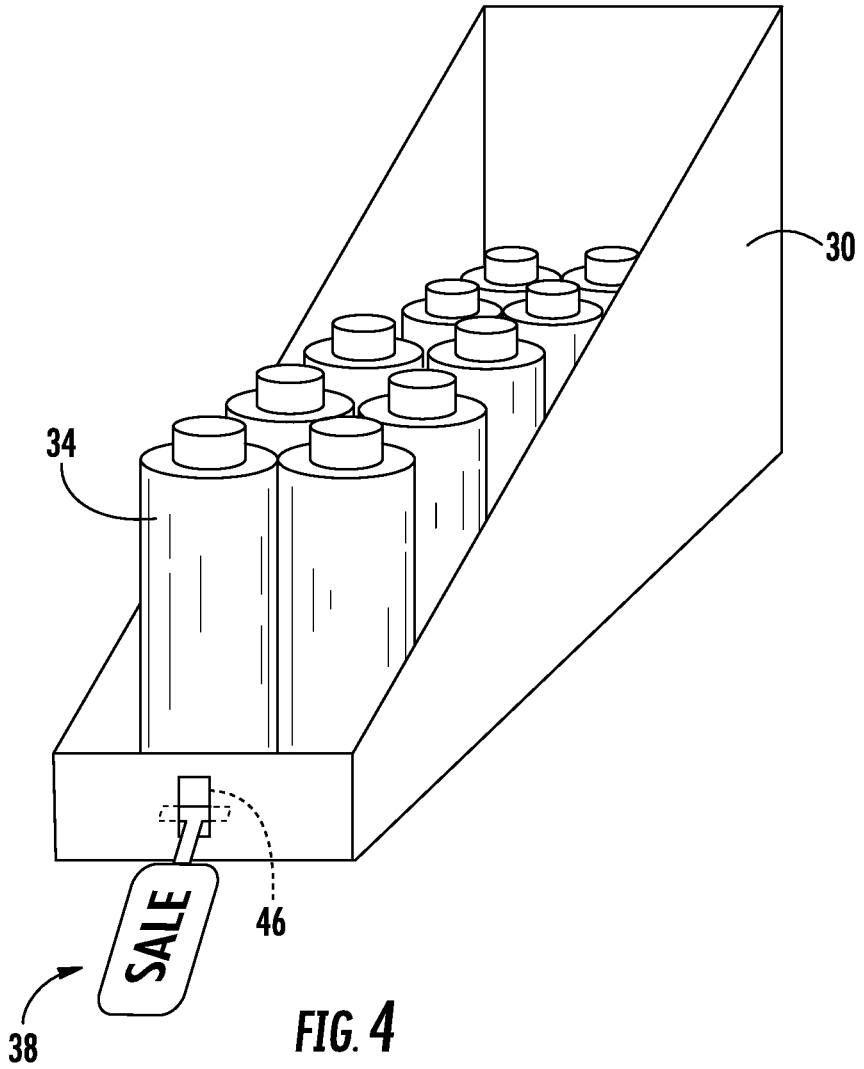
FIG. 4 is a perspective view of the open carton with a shelf tag installed therein.

Referring to FIG. 3, in use, the display tag 38 would be punched out and removed from the upper portion 32, and the tab 42 would be inserted into the slot 46, so that the display tag 38 is exposed to a shopper. Alternatively, the display tag 38 could be attached by some other means such as adhesive or fasteners. In general, this type of tag which extends beyond the shelf (not shown), may be referred to as a "shelf talker". FIG. 4 shows the completely assembled carton. This serves to attract a shopper's attention to the product. In FIG. 4, the display tag 38 is shown hanging at a generally downward angle. However, it will be understood that the display tag 38 may be configured to extend straight out (i.e. horizontally), upwards, laterally towards either side of the carton 26, or in any other desired direction. The display tag 38 may include any desired techs, indicia, graphics as desired to attract a shopper's attention and/or convey information.

Compared to the prior art, the carton 26 has the benefit of providing a convenient shelf talker and reducing waste.

The foregoing has described a storage and display carton. All of the features disclosed in this specification, and/or all of the steps of any method or process so disclosed, may be combined in any combination, except combinations where at least some of such features and/or steps are mutually exclusive.

Each feature disclosed in this specification may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends, or to any novel one, or any novel combination, of the steps of any method or process so disclosed.

What is claimed is:

1. A blank for a carton, comprising:

a sheet of material defining a plurality of panels separated by a plurality of fold lines, the panels defining an enclosure including first perforation lines which demarcate a separation of the enclosure into a lower portion and an upper portion, the first perforation lines configured to permit the upper portion to be torn away and removed from the lower portion;

the panels within the lower portion defining an open-top enclosure; and the upper portion including second perforation lines defining a display tag, the second perforation lines configured to permit the display tag to be punched out and removed from the upper portion; and wherein the lower portion includes third perforation lines defining a slot sized to receive a portion of the display tag.

2. The blank of claim 1 wherein the display tag comprises a body and a tab.

3. The blank of claim 2 wherein the tab is T-shaped.

4. The blank of claim 2 wherein the body of the display tag is rectangular with a pair of opposed long edges and a pair of opposed short edges, and the tab extends from one of the short edges.

5. The blank of claim 1 wherein the lower portion includes a front wall, a back wall which is taller than the front wall, and sloping sidewalls interconnecting the front and back walls.

6. The blank of claim 1 wherein the panels include, in sequence: a first side wall, a front wall, a second side wall, a back wall, and the first perforation lines extend diagonally along the first and second side walls.

7. The blank of claim 6 wherein a bottom flap extends from each of the front wall, the first and second side walls, and the back wall.

8. A carton, comprising:

a plurality of interconnected panels which define an outer enclosure, the panels including first perforation lines which demarcate a separation of the outer enclosure into a lower portion and an upper portion, the first perforation lines configured to permit the upper portion to be torn away and removed from the lower portion;

the upper portion including second perforation lines defining a display tag, the second perforation lines configured to permit the display tag to be punched out and removed from the upper portion; and the lower portion including third perforation lines defining a small piece that may be punched out to form a slot sized to receive a portion of the display tag therein.

9. The carton of claim 8 wherein the first perforation lines extend diagonally across sidewalls defined by the panels.

10. The carton of claim 8 wherein the display tag comprises a body and a tab.

11. The carton of claim 10 wherein the tab is T-shaped.

12. The carton of claim 10 wherein the body of the display tag is rectangular with a pair of opposed long edges and a pair of opposed short edges, and the tab extends from one of the short edges.

13. The carton of claim 8 wherein the lower portion includes panels defining a front wall, a back wall which is taller than the front wall, and sloping sidewalls interconnecting the front and back walls.

14. The carton of claim 8 wherein the panels include, in sequence: a first side wall, a front wall, a second side wall, a back wall, and the first perforation lines extend diagonally along the first and second side walls.

15. The carton of claim 14 wherein a bottom flap extends from each of the front wall, the first and second side walls, and the back wall.

16. A method of displaying a product, comprising:

providing a carton including a plurality of interconnected panels which define an enclosure, the panels including first perforation lines which demarcate a separation of the outer enclosure into a lower portion and an upper portion, the upper portion further including second perforation lines defining a display tag, the first perforation lines configured to permit the upper portion to be torn away and removed from the lower portion, and the second perforation lines configured to permit the display tag to be punched out and removed from the upper portion, and the lower portion including third perforation lines defining a slot sized to receive a portion of the display tag, wherein at least one product is contained within the enclosure;

separating the upper portion from the lower portion along the first perforation lines and removing the upper portion to expose the at least one product contained within the lower portion;

separating the display tag from the upper portion along the second perforation lines;

punching out the third perforation lines to form a slot sized to receive a portion of the display tag therein; and attaching the display tag to the lower portion by inserting a portion of the display tag into the slot.

* * * * *